United States Patent [19]

Schmidt

[11] 4,074,543

[45] Feb. 21, 1978

[54] LACE AND A METHOD FOR ITS MANUFACTURE

[75] Inventor: Frederick O. G. Schmidt, Mohnton, Pa.

[73] Assignee: Allura Corporation, Reading, Pa.

[21] Appl. No.: 735,466

[22] Filed: Oct. 26, 1976

[51] Int. Cl.[2] ..... D04B 21/00

[52] U.S. Cl. ..... 66/193

[58] Field of Search ..... 66/190, 192, 195, 193

[56] References Cited

U.S. PATENT DOCUMENTS

| | | | |
|---|---|---|---|
| 1,139,344 | 5/1915 | Clewley | 66/195 |
| 1,187,158 | 6/1916 | McGinley | 66/195 |
| 2,691,286 | 10/1954 | Cooper | 66/192 |
| 3,308,827 | 3/1967 | Gross | 66/195 |

OTHER PUBLICATIONS

Wheatley, B., Raschel Lace Production, N. Y., National Knitted Outerwear Association, 1972, pp. 61–70.

Paling, D. F., Warp Knitting Technology, Great Britain, Columbine Press, 1965, pp. 166–167.

*Primary Examiner*—Mervin Stein

*Assistant Examiner*—Andrew M. Falik

*Attorney, Agent, or Firm*—M. Richard Page

[57] ABSTRACT

A lace pattern comprised of a repetitive pattern of squares circumscribing small six-sided figures and a method for its manufacture on a raschel warp-knitting machine. The lace closely approximates laces made on bobbin-net machines and is dimensionally stable along both of its principal axes.

3 Claims, 5 Drawing Figures

FIG. 4
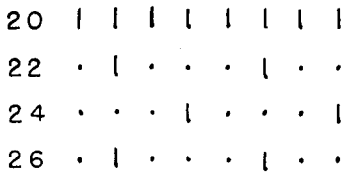
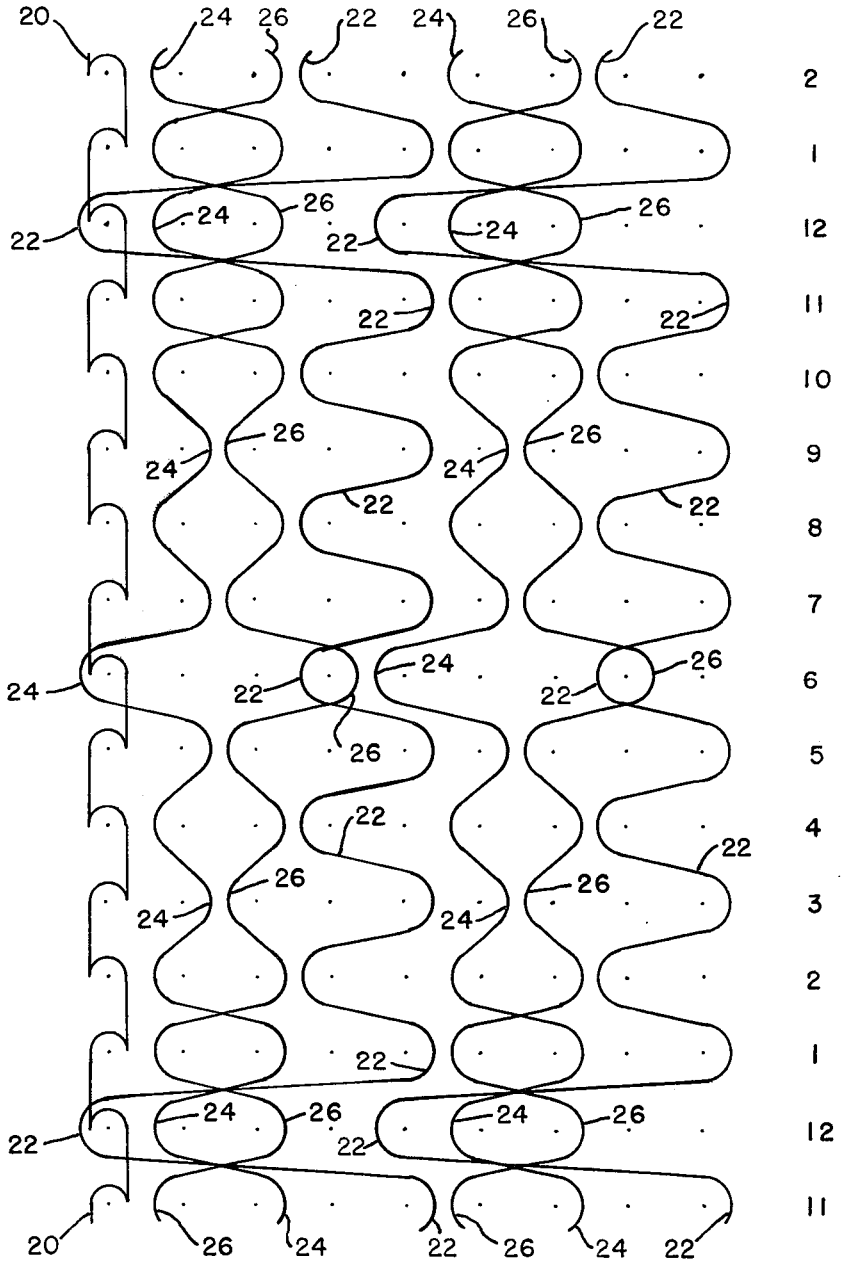
FIG. 3

LACE AND A METHOD FOR ITS MANUFACTURE

BACKGROUND OF THE INVENTION

1. Field of the Invention

This invention relates to the design of a lace (netting) and a method for its manufacture on a raschel warp-knitting machine. The configuration of the lace pattern closely approximates laces made on bobbin-net or Leevers machines (lace machines) and which, in addition to being aesthetically pleasing, results in a stable fabric that does not stretch and retains its configuration when a strain is applied in either the warp or the weft direction.

2. Description of the Prior Art

Laces or netting were originally manufactured abroad on the so-called lace machines — that is, bobbin-net or Leevers machines. The fabrics produced by these machines are characterized by small regular meshes of various form, such as hexagonal, and are of the highest quality. The labor cost of operating these lace machines is so high, however, that the use of them for the manufacture of lace is largely precluded in countries enjoying high living standards. For this reason, laces of this type are produced essentially only in countries where wages are sufficiently low to permit economic production.

In more recent times, imitations of these laces have been warp-knit on machines such as raschel warp-knitting machines which can be operated at reasonably high speeds and with a comparatively low labor factor. A number of different lace patterns have been successfully produced in this manner simulating, to a greater or lesser extent, the laces made on the bobbin-net machines. As a generalization, these warp-knit laces are not dimensionally stable in that if a strain is applied, either in the warp or weft direction, the lace will deform due to the instability of the knitted pattern.

SUMMARY OF THE INVENTION

Accordingly, it is an object of this invention to provide a new pattern of lace and a method for its manufacture on a raschel warp-knitting machine.

Another object of this invention is to provide a lace that can be manufactured on a raschel warp-knitting machine that has a basic repetitive pattern of squares circumscribing six-sided figures, which lace is aesthetically pleasing and simulates the overall appearance of a lace made on a bobbin-net machine.

Yet another object of this invention is to provide a lace pattern and a method for its manufacture, that is dimensionally stable and that will not distort when strained in either the warp or weft direction.

These and other objects of this invention are achieved through the utilization of two distinct groups of threads on a raschel warp-knitting machine. The primary group of threads are repetitively chain-stitched to provide a plurality of adjacent but independently looped threads (wales). The secondary group of threads are not looped or knitted, but rather are laid in to the loops of the primary threads. It is the function of the secondary threads to interconnect and fix the orientation of the primary threads with respect to each other. Thus, there is achieved a lace in which one of the knitted wales are knit to each other and the pattern of the lace is established solely through the action of the unlooped laid-in threads that fixedly position the knitted wales with respect to each other.

DESCRIPTION OF THE DRAWINGS

FIG. 3 is an enlarged diagrammatic illustration of the arrangement of the threads forming a variation of the lace pattern shown in FIG. 1;

FIG. 4 is a schematic illustration indicating how guide bars are threaded for use in producing the lace of this invention.

Figure 1:
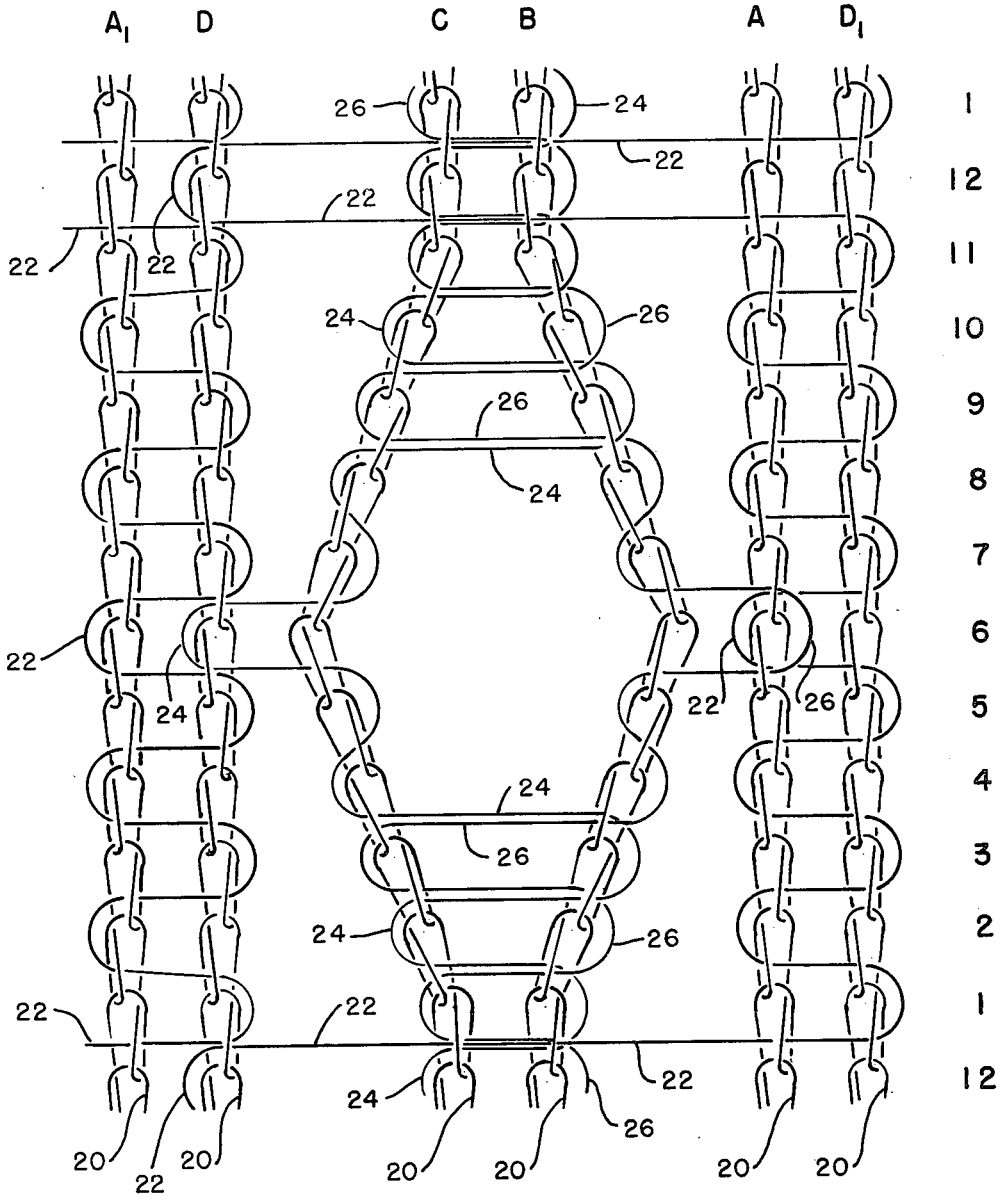
FIG. 1 is an enlarged diagramatic illustration of the arrangement of the threads forming the lace of this invention.

No details of a raschel warp-knitting machine are shown in the drawing or described herein since these machines are old and their mechanisms are well known to those of ordinary skill in the art. Suffice it to say that the raschel machines have a plurality of guide bars that are reciprocated in relation to the needle bar by individual links of chains (or a cam wheel) that have various depths. After the guide bars are positioned during each course by a link of the chain, the needle bar holding the needles is actuated by means of a cam and the desired stitch is made.

Referring to the drawings, a schematic representation of the lace fabric of this inventon is disclosed as well as a partial pattern chain drawing. In both of the drawings, numerals 1 through 12 are used to identify the various courses through one repeat of the pattern and letters A through D are used in FIG. 1 to designate the wales in one repeat of the pattern and $A_1$ and $D_1$ to designate wales of adjacent repeats.

First, with respect to the wales, as can best be seen in FIG. 1, wales A, B, C and D (and $A_1$ and $D_1$) are formed from threads 20—20 that are continuously chain-stitched so that each thread 20—20 is looped onto itself at every course. Note, however, that none of the threads 20—20 are looped onto each other.

Laid into the loops of the wales A, B, C and D are unlooped threads 22, 24 and 26. It can be understood from the drawing that if these unlooped threads 22, 24 and 26 were not present, the result would be a series of parallel, equally-spaced-apart, unconnected chain-stitched threads $D_1$, A, B, C, D and $A_1$. It is thus the function of the laid-in unlooped threads 22, 24 and 26 to orient and lock the wales $D_1$, A, B, C, D and $A_1$ in the desired positions. By these means, the configuration of the lace and its dimensional stability are established and controlled by the participation of the laid-in, unlooped threads 22, 24 and 26.

Considering first the path of unlooped thread 22, it can be seen that with each course, it passes first in one direction and then in another direction through adjacent marginal wales $A_1$ and D and A and $D_1$ to hold adjacent repetitive patterns together and establish the edge of the pattern in the warp direction. At every twelfth course, the thread 22 is shogged across an entire pattern repeat in the width direction so that the marginal wales A and $D_1$ on the right side of the repeat pattern as shown in the drawing are connected to the marginal wale D on the other side of the pattern. When the thread 22 is shogged across on the twelfth course, it is passed through the loops of wales B and C to further secure the configuration of the structure. Since thread 22 is shogged over and back in successive courses 12 and 1, any strain applied upon the lace fabric in the weft direction will be taken along the axis of the thread 22 to resist stretching or deformation of the lace pattern in this direction.

As noted above, side wales A and D are secured to the side wales $D_1$ and $A_1$ of the adjacent repeat by unlooped thread 22. If a strain is applied to the lace in the warp direction, the forces will be taken along the axis of wales $A_1$, D, C, B, A and $D_1$ to resist stretching or deformation of the lace pattern in the warp direction.

Reference is now made to the unlooped laid-in threads 24 and 26. The movement of each of these yarns through the loops of wales D and C and B and A respectively is identical except that they are mirror images of each other. At course 12, the beginning of a repeat, and for one or a few more courses on either side of course 12, unlooped yarns 24 and 26 both pass through, from opposite directions, the looped wales B and C and hold them together. After these few courses adjacent the repeat, thread 24 is laid into the loops of wale C only and thread 26 is laid into the loops of wale B only so that wales C and B are no longer secured to each other and may be laterally positioned independent of each other. At the sixth and seventh courses, thread 24 is shogged over to marginal wale D and back so that wale C is moved laterally and held positioned by the connection to wale D provided by thread 24. In a similar fashion, thread 26 laterally positions wale B by the interconnection it provides to wale A. By so controlling the movement of threads 24 and 26 and the positioning of wales C and B, a six-sided figure is established within the overall square pattern. In the ensuing courses, after wales B and C have been spread apart, threads 24 and 26 are again laid into the loops of their respective wales C and B for several courses, and then wales C and B are again connected to each other near the beginning of the next repeat of the pattern.

Figure 2:
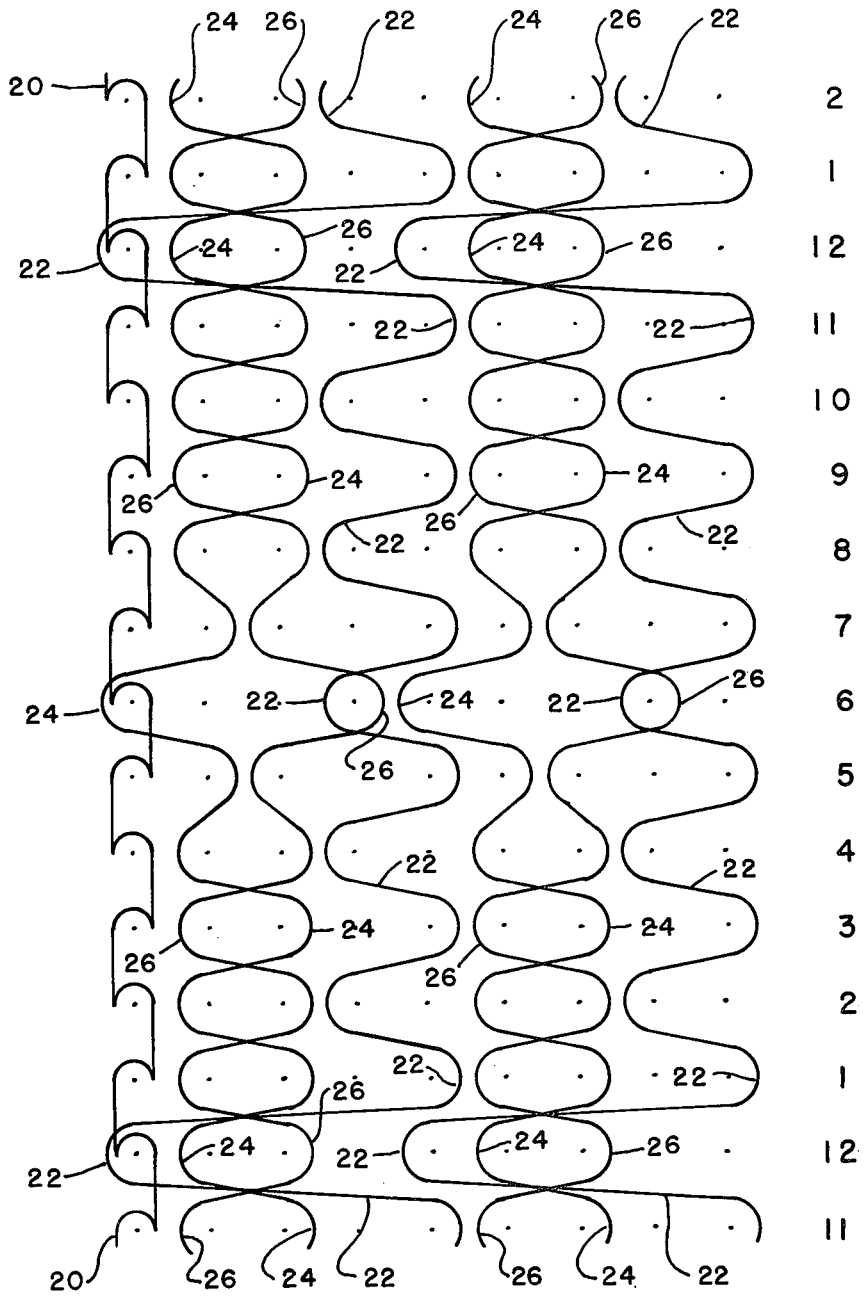
FIG. 2 is a pattern chain diagram for making the lace illustrated in FIG. 1.

The above description is equally applicable to the pattern chain diagram of FIG. 2 with the exception that the continuous chain stitching of only one wale is shown at the left margin. The others have been omitted for purposes of clarity so that the chain pattern of the unlooped threads 22, 24 and 26 would not be partially obscured.

FIG. 3 is a chain drawing similar to that of FIG. 2 showing a slight modification that causes the figure within the square of the net pattern of this invention to be slightly more open. As can be seen, this is accomplished by not looping together laid-in threads 24 and 26 at courses 3 and 9.

FIG. 4 schematically illustrates how the guide bars for threads 20, 22, 24 and 26 are threaded. In this diagram, the vertical lines indicate a thread passing through a guide bar and the dots illustrate an open guide bar.

Figure 5:
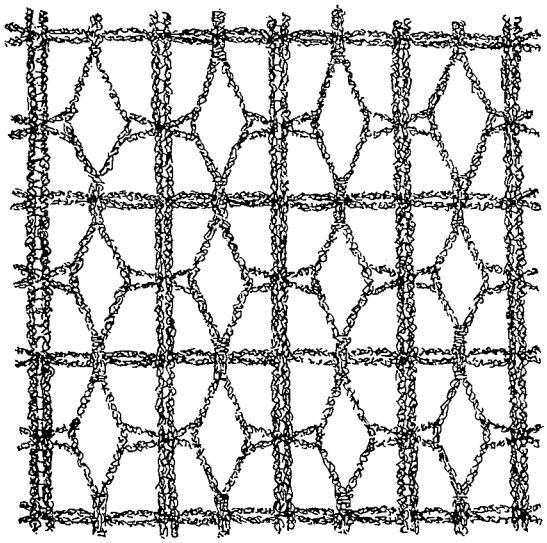
FIG. 5 is a drawing which diagrammatically illustrates several repeats of net fabric made in accordance with this invention.

FIG. 5 is a diagrammatic illustration of several repeats of the net fabric of this invention.

The chain pattern (or pattern wheel) for making the lace as illustrated in the drawings is as follows:

| | CHAIN NOTATION | | | |
|---|---|---|---|---|
| Course | No. 1 Bar Threads 20 | No. 2 Bar Threads 24 | No. 3 Bar Threads 26 | No. 4 Bar Threads 22 |
| 1 | 2 | 0 | 6 | 0 |
| | 0 | 0 | 6 | 0 |
| 2 | 0 | 4 | 2 | 4 |
| | 2 | 4 | 2 | 4 |
| 3 | 2 | 0 | 6 | 0 |
| | 0 | 0 | 6 | 0 |

-continued

| | CHAIN NOTATION | | | |
|---|---|---|---|---|
| Course | No. 1 Bar Threads 20 | No. 2 Bar Threads 24 | No. 3 Bar Threads 26 | No. 4 Bar Threads 22 |
| 4 | 0 | 4 | 2 | 4 |
| | 2 | 4 | 2 | 4 |
| 5 | 2 | 2 | 4 | 0 |
| | 0 | 2 | 4 | 0 |
| 6 | 0 | 6 | 0 | 4 |
| | 2 | 6 | 0 | 4 |
| 7 | 2 | 2 | 4 | 0 |
| | 0 | 2 | 4 | 0 |
| 8 | 0 | 4 | 2 | 4 |
| | 2 | 4 | 2 | 4 |
| 9 | 2 | 0 | 6 | 0 |
| | 0 | 0 | 6 | 0 |
| 10 | 0 | 4 | 2 | 4 |
| | 2 | 4 | 2 | 4 |
| 11 | 2 | 0 | 6 | 0 |
| | 0 | 0 | 6 | 0 |
| 12 | 0 | 4 | 2 | 10 |
| | 2 | 4 | 2 | 10 |

The configuration of the circumscribed six-sided figure illustrated in the drawings can be altered to make it more or less opened or closed by altering the number of courses in which threads 24 and 26 interconnect wales C and B with each other. For example, if wales B and C are joined only at course 12 and a single course on either side, a more open six-sided figure than is shown in the drawings will be established. A suitable chain pattern for this modification is as follows:

| | CHAIN NOTATION | | | |
|---|---|---|---|---|
| Course | No. 1 Bar Threads 20 | No. 2 Bar Threads 24 | No. 3 Bar Threads 26 | No. 4 Bar Threads 22 |
| 1 | 2 | 0 | 6 | 0 |
| | 0 | 0 | 6 | 0 |
| 2 | 0 | 4 | 2 | 4 |
| | 2 | 4 | 2 | 4 |
| 3 | 2 | 2 | 4 | 0 |
| | 0 | 2 | 4 | 0 |
| 4 | 0 | 4 | 2 | 4 |
| | 2 | 4 | 2 | 4 |
| 5 | 2 | 2 | 4 | 0 |
| | 0 | 2 | 4 | 0 |
| 6 | 0 | 6 | 0 | 4 |
| | 2 | 6 | 0 | 4 |
| 7 | 2 | 2 | 4 | 0 |
| | 0 | 2 | 4 | 0 |
| 8 | 0 | 4 | 2 | 4 |
| | 2 | 4 | 2 | 4 |
| 9 | 2 | 2 | 4 | 0 |
| | 0 | 2 | 4 | 0 |
| 10 | 0 | 4 | 2 | 4 |
| | 2 | 4 | 2 | 4 |
| 11 | 2 | 0 | 6 | 0 |
| | 0 | 0 | 6 | 0 |
| 12 | 0 | 4 | 2 | 10 |
| | 2 | 4 | 2 | 10 |

From the foregoing, it can be understood that a lace may be made on a raschel warp-knitting machine that is characterized by a repetitive pattern of a number of squares containing within their interior small six-sided figures. The lace of this invention is dimensionally stable because a portion of the threads of construction extend longitudinally in the warp direction and a portion of the threads extend longitudinally in the weft direction so that strains can be accommodated along either principal axis of the lace.

It is noted that while it is not necessary to reproduce an exact square in the repetitive pattern, it is desirable, for the sake of appearance, to approach it as closely as possible. For example, in a preferred embodiment of this invention utilizing a raschel machine having eighteen needles to the inch (36 gauge), the square design is properly proportioned by utilizing twelve courses as the repetitive pattern. The take-up speed of the machine may also be altered to adjust the proportioning of the square.

The lace or net as here described is basically a foundation netting upon which other threads can be inlaid. As the variation of these inlays and their effect upon the overall appearance forms no part of this invention, it has been disclosed only in terms of the base pattern.

In the preferred practice of this invention, since the stability of the net fabric in the weft direction is essentially dependent upon the strain that can be accomodated by unlooped yarn 22, it is preferred that yarn 22 be of higher denier or tenacity than the other yarns 20, 24 and 26.

I claim:

1. A net material knit on a raschel knitting machine characterized in appearance by a repetitive pattern of squares that circumscribe small six-sided figures, the net being defined by a primary and a secondary group of threads, each thread of the primary group being continuously chain-stitched to provide a plurality of adjacent, independent knitted wales, each thread of the secondary group being unlooped with respect to itself but laid into the loops of the wales of the primary group in a selected manner that fixedly positions the wales with respect to each other and establishes the pattern of the lace, a first thread of the secondary group passing through the loops of an adjacent pair of wales to form the side edges of adjacent pattern repeats and link them together, the first thread of the secondary group also being caused to interconnect in the weft direction the opposite sides of a given repeat unit to complete the square pattern in the weft direction, a second adjacent pair of knitted wales partially displaced and held in the weft direction within the interior of the defined square of the netting by a second and third thread of the secondary group of threads, the second and third threads of the secondary group joining the wales of the second pair to each other adjacent the top and bottom of the repeat pattern intermediate the side edges and joining each wale of the second pair to the adjacent wale of the first pair at a midpoint in the side wall of the square in the warp direction.

2. A net material according to claim 1 wherein four guide bars are utilized to control four sets of threads with the following cam or chain pattern: Guide Bar 1 - 2-0/0-2/2-0/0-2/2-0/0-2/2-0/0-2/2-0/0-2/2-0/0-2 Guide Bar 2 - 0-0/4-4/0-0/4-4/2-2/6-6/2-2/4-4/0-0/4-4/0-0/4-4 Guide Bar 3 - 6-6/2-2/6-6/2-2/4-4/0-0/4-4/2-2/6-6/2-2/6-6/2-2 Guide Bar 4 - 0-0/4-4/0-0/4-4/0-0/4-4/0-0/4-4/0-0/4-4/0-0/10-10.

3. A net material according to claim 1 wherein four guide bars are utilized to control four sets of threads with the following cam or chain pattern: Guide Bar 1 - 2-0/0-2/2-0/0-2/2-0/0-2/2-0/0-2/2-0/0-2/2-0/0-2 Guide Bar 2 -0-0/4-4/2-2/4-4/2-2/6-6/2-2/4-4/2 -2/4-4/0-0/4-4 Guide Bar 3 - 6-6/2-2/4-4/2-2/4-4/0-0/4-4/2-2/4-4/2-2/6-6/2-2 Guide Bar 4 - 0-0/4-4/0-0/4-4/0-0/4-4/0-0/4-4/0-0/4-4/0-0/10-10.

* * * * *